United States Patent [19]

Hockenbrock

[11] 4,379,978

[45] Apr. 12, 1983

[54] MEANS AND METHOD FOR MAKING ELECTRICAL CONNECTION TO CATHODE RAY TUBES

[75] Inventor: Richard L. Hockenbrock, Mundelein, Ill.

[73] Assignee: Zenith Radio Corporation, Glenview, Ill.

[21] Appl. No.: 245,796

[22] Filed: Mar. 20, 1981

[51] Int. Cl.[3] ..... H01J 5/48

[52] U.S. Cl. ..... 313/318; 313/331; 339/144 R

[58] Field of Search ..... 313/318, 331, 333, 482, 313/238, 243, 177; 339/144 T; 174/50, 52

[56] References Cited

U.S. PATENT DOCUMENTS

| | | | |
|---|---|---|---|
| 254,641 | 0/1882 | Guest | 313/318 |
| 503,108 | 0/1893 | Bates | 313/318 |
| 2,204,204 | 6/1940 | Baier | 313/318 |
| 2,659,836 | 11/1953 | Germer | 313/331 |
| 3,227,910 | 1/1966 | Pittman | 313/318 |
| 3,260,888 | 7/1966 | Webb | 313/318 |
| 3,278,886 | 11/1966 | Blumenberg et al. | 339/145 T |
| 3,377,612 | 4/1968 | Klier et al. | 313/318 |
| 3,997,809 | 12/1976 | Kyp | 313/318 |
| 4,243,907 | 1/1981 | Kohl | 339/184 R |

*Primary Examiner*—Harold A. Dixon

[57] ABSTRACT

A cathode ray picture has a neck terminated by a plurality of electrically conductive pins extending axially from the neck terminus. The tube is characterized by each pin having an electrically conductive wire attached thereto. A base in abutting relationship to the neck terminus comprises an insulative member filled with an electrically insulative adhesive. The base has a closed end facing away from the neck terminus. The base includes a plurality of apertures equal in number to the wires for spacedly receiving and passing the wires. The wires are electrically isolated one from the others by the spacing and the insulative adhesive, and the base is adhered to the neck terminus by the adhesive.

6 Claims, 6 Drawing Figures

MEANS AND METHOD FOR MAKING ELECTRICAL CONNECTION TO CATHODE RAY TUBES

BACKGROUND OF THE INVENTION AND PRIOR ART STATEMENT

This invention relates to cathode ray display tubes, and is particularly concerned with the base of such tubes that provides for passing and isolating a number of electrically conductive pins that convey operating voltages into the tube envelope.

Cathode ray tubes used in television picture tubes, and in CRT monitors displaying a variety of information, typically have a narrow neck terminated by a plurality of electrically conductive pins extending axially from the neck. The pins may comprise a number of closely spaced, low-voltage pins, and at least one high-voltage pin widely spaced from the low-voltage pins. The potentials conducted by the low-voltage pins may range from less than one volt to one kilovolt, for example. The potentials conducted by the high-voltage pin are typically in the range of six to twelve kilovolts, or greater. In certain television tube applications, an additional very high potential termed the "anode potential" is in the range of 25–32 kilovolts, and is introduced through the tube envelope by means of an "anode button" which passes through the anode in the cathode ray tube funnel region.

Electrical connection to the pins is typically made by a socket which provides for connecting by means of a plurality of frictional members which slidably contact each pin. The members are attached to a plurality of lead wires which in turn make connection to various components of the ancillary electrical chassis, such as the power supply and scanning circuits. To ensure electrical isolation of the high-voltage pins from the low-voltage pins, the aforedescribed base may have a plurality of axially and radially outwardly extending insulating walls which isolate the pins one from the others to prevent inter-pin arcing. The pins which conduct the high voltages may be further isolated from the low-voltage pins and from each other, by an elaborate system of insulating walls and cavities. A base of this type, which in conjunction with a socket system, provides for high voltage arc prevention between adjacent pins is described and claimed in U.S. Pat. No. 4,075,531, assigned to the assignee of the present invention.

It is a common practice to supplement the insulation provided by the base by the addition of an electrically insulative material into a cavity surrounding the pins. The insulative material is also an adhesive which provides for adhering base the to the neck terminus. The insulative material may comprise a thermo-setting polymer adhesive.

A separable, socket-type connection may be inexpedient in certain applications such as, for example, a cathode ray tube used in a vehicular dashboard display, or an aircraft cockpit display. As the electrical contact made by the socket with the base is frictional, near-zero-resistance electrical connections are not assured. While of little consequence where higher voltages are concerned, near-zero-resistance connections are essential in very low voltage connections, such as the filament connections in directly heated cathodes. A cathode of this type may require, for example, a voltage of 0.64, with a tolerance of ±0.02 volt. Any appreciable variance from the limits specified affects the warm-up time.

In case of an under-voltage condition, the cathode may be subject to premature failure due to poisoning from under heating. Further, with a frictional contact arrangement, the pins are exposed to the environment and are thus subject to corrosion, dust and moisture which can appreciably increase the electrical resistance of the contact areas with time.

OBJECTS OF THE INVENTION

It is a general object of this invention to provide improved means and method for making electrical connections to cathode ray tubes.

It is another general object of the invention to provide improved means and method for making electrical connections to cathode ray tubes without the need for a separable, socket-base connector.

It is yet another general object of the invention to provide for high-voltage conduction through the narrow neck of certain cathode ray tubes rather than through an anode button in the funnels;

It is a less general object of the invention to provide for shortening the length of certain cathode ray tubes.

It is a more specific object of the invention to provide for the introduction of higher voltages through the tube base than is possible in tubes having conventional socket-base interconnections.

It is another more specific object of the invention to provide means and method for making near-zero-resistance electrical connection to cathode ray tubes having directly-heated cathodes.

It is a specific object of the invention to provide means and method for isolating the electrically conductive pins entering the neck of the cathode ray tube, and for adhering a base to the neck terminus.

BRIEF DESCRIPTION OF THE DRAWINGS

The features of the present invention which are believed to be novel are set forth with particularity in the appended claims. The invention, together with further objects and advantages hereof, may best to be understood by reference to the following description taken in conjunction with the accompanying drawings, in the several figures of which like reference numerals identify like elements, and in which:

DESCRIPTION OF THE PREFERRED EMBODIMENTS

Figure 1:
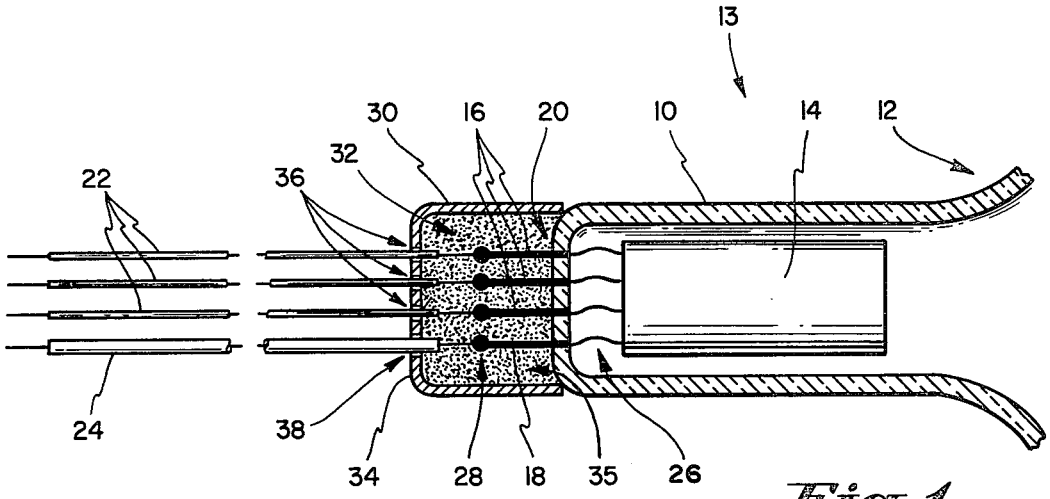
FIG. 1 is a cross-sectional view of the neck and a part of the funnel of a cathode ray tube depicting an embodiment of the means for making electrical connection to a cathode ray tube according to the invention.
Figure 2:
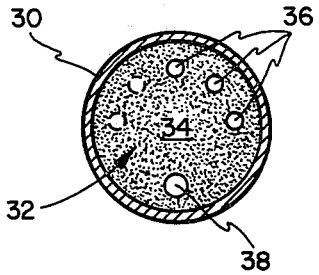
FIG. 2 is a plan view looking into a member of the connecting means according to the invention and showing holes for receiving and passing electrical wires.

A means for making electrical connection to a cathode ray tube according to the invention is depicted in FIGS. 1 and 2. A narrow neck 10 and a section of a funnel 12 will be recognized by those skilled in the art as comprising sections of the envelope of a cathode ray picture tube 13, the entirety of which is not shown. An electron gun 14, shown schematically as a cylinder is depicted as being enclosed in neck 10.

Neck 10 is shown as being terminated by a plurality of closely spaced, electrically conductive low-voltage pins 16, and at least one high voltage pin 18 extending axially from the neck terminus 20. High voltage pin 18 is typically relatively widely spaced from the low-voltage pins 16. Cathode ray tube 13 is characterized by each of the low-voltage pins 16 having a relatively thinly insulated, relatively small-diameter wire 22 attached thereto, while a relatively thickly insulated, relatively large-diameter wire 24 is attached to high-voltage pin 18. The voltages conducted into cathode ray tube 13 are required for operation of electron gun 14, shown as being connected to pins 16 and 18 by a plurality of conductors 26 located within neck 10. It is to be understood that the plurality of pins 16 and wires 22 may comprise many more than those depicted for exemplary purposes. Typically, the number of pins 16 and wires 22 may be as many as six or more in a single gun—two for the filaments, for example, and four for the various electodes; also, there may be many more in tubes having multiple electron guns. Similarly, there may be more than one high-voltage pin 18 and conductor 24, again depending upon the operational requirements of the gun. The scope of the invention is not limited to the number of pins and wires shown, but is intended to cover both standard and unusual gun configurations to which the invention has application.

Thinly insulated wires 22 may conduct potentials in the range of less than a volt and up to one kilovolt, for example. The gauge of the wire may range from No. 28 to No. 18, depending upon specific current-carrying requirements, and the insulation may comprise types well-known for use in low-voltage applications.

High-voltage wire 24 may comprise No. 20 or 24 gauge wire, for example, and have an insulation thickness suitable for conducting potentials of as much as fifteen kilovolts. In certain cathode ray tubes where an electron gun 14 requires an anode or focus potential of up to fifteen kilovolts, the high-voltage conduction through the terminus 20 of the neck 10 makes unnecessary the use of a separate anode button in the funnel section. The benefits of the invention include a simplification in tube design and manufacture, and simplified interconnection of the cathode ray tube with the associated electrical chassis used to power, scan and modulate the tube.

Pins 16 and 18 are shown as being attached at attachment points 28, indicated schematically by a series of large dots, to the metallic conductive element of wires 22 and 24, respectively. Attachment is preferably by a process that provides a near-zero-resistance electrical connection, such as by percussive or resistive welding, or by high-temperature silver-soldering. Such means of attachment are beneficial, especially in cathode ray tubes with an electron gun having directly heated cathodes operating at potentials of less than a volt. The voltage tolerance of such tubes may be within three percent, or 0.020 volt, for example, and a standard disconnectable socket-base assembly normally could not provide or maintain with time the near-zero-resistance connection required.

Cathode ray tube 13 is shown as having a base 30 in abutting relationship to terminus 20 of neck 10. Base 30 comprises an insulative cylinder filled with an insulative adhesive 32, which is indicated schematically by the small dot pattern. Base 30, which may be of a diameter substantially equal to the diameter of neck 10, preferably consists of a moldable plastic of high-dielectric strength and with the capability of tolerating a temperature of at least 400 degrees Farenheit. Compositions of this type are well known to those skilled in the art; polyethylene is an example. Wall thickness is preferably about 0.10 inch. The insulative adhesive is preferably a silicone-based, thermo-setting polymer adhesive that provides effective inter-pin and inter-wire insulation, and positive adherence to the neck terminus 20. An example of an effective adhesive is Silastic (TM) manufactured by General Electric under the designation silicone adhesive CRTV6424. Upon heating, the material becomes an elastomer with highly insulative and adhesive qualities.

It will be seen that base 30 has a closed end 34 facing away from neck terminus 20; open end 35 faces toward neck terminus 20. With specific reference to FIG. 2, closed end 34 is depicted as having a plurality of relatively small diameter holes 36 therethrough for receiving and passing, in spacing alike to low-voltage pins 16, the low-voltage wires 22. Also, base 30 has a large diameter hole 38 for receiving and passing, in spacing alike to said high-voltage pin 18, high-voltage wire 24. The diameter of the respective holes should be such as to provide for easy entry of the respective wires, yet snug enough so that little of the insulative adhesive 32 escapes during assembly. The means according to the invention are such that low-voltage wires 16 are electrically isolated one from the others and from high-voltage wire 18 by virtue of the spacing and the insulative adhesive when it has been thermally set. Also, when the adhesive is set, it provides for positive adherence of the base 30 to the neck terminus 20.

Figure 3:
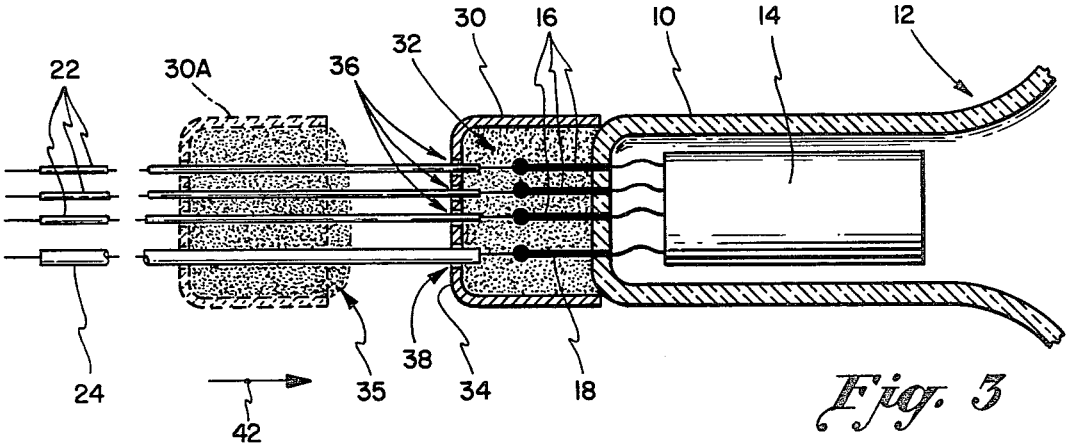
FIG. 3 is a view similar to FIG. 1, but showing certain steps in the method according to the invention for making connection to the pins extending from the neck.

An improved method for making electrical connection to the axially extending pins of a cathode ray tube comprises the following, as set forth in ensuing paragraphs, with additional reference to FIG. 3. A relatively thinly insulated, relatively small diameter low-voltage wire 22 is attached to each of the low-voltage pins 16. A relatively thickly insulated, relatively large diameter high-voltage wire 24 is attached to the high-voltage pin 18. An electrically insulative cylindrical base 30 of a diameter substantially equal to the diameter of neck 10 is provided. Base 30 has an open end 35 and a closed end 34. A plurality equal in number to the low-voltage pins 16 of small-diameter holes 36 are provided in closed end 34 for receiving and passing low-voltage wires 22. The holes 36 are alike in spacing to low-voltage pins 16. A relatively large-diameter hole 38 is provided in the closed end 34. The hole is alike in spacing to the high-voltage pin 18. Hole 38 provides for receiving and passing high-voltage wire 24.

As indicated by the dotted configuration 30A of base 30 in FIG. 3, the low-voltage wires 22 and the high-voltage wire 24 are threaded into the open end 35 of base 30 and wires 22 and 24 are passed through respective holes 36 and 38 in the closed end 34. The base is filled with a thermo-setting insulative adhesive 32, as indicated schematically by the small dot pattern. Preferably, the base is slightly overfilled with adhesive to insure positive contact of the adhesive 32 with the neck terminus 20. Any excess can easily be wiped off. Base 30 should be filled with the insulative adhesive 32 when base 30 is about an inch from the neck terminus 20, as indicated by configuration 30A; otherwise, overmuch adhesive 32 will be expelled through holes 36 and 38. Some expelling is desirable as a method of releasing entrained air which may create voids conducive to inter-pin and inter-wire arcing. Base 30 is slid along wires 22 and 24 such that base 30 and the adhesive 32 are in abutting relationship with a neck terminus 20, as indicated by arrow 42.

Base 30 is then heated to a temperature effective to thermo-set adhesive 32. Heating of the material to provide adhesion is preferably accomplished by suspending the tube from a conveyer and passing the base end through a lehr that applies approximately 150–170 degrees centigrade of heat to the base for about fifteen minutes.

Other changes may be made in the above-described means and method without departing from the true scope of the invention herein involved. For example, the invention may have the configuration of the embodiment shown by FIGS. 4, 5 and 6. A narrow neck 46 is depicted as being terminated by a plurality—shown for example as being three—of closely spaced, electrically conductive, low-voltage pins 52, shown as being relatively short. At least one-high voltage pin, shown as being two pins 54 and 56 in this example, are indicated as being relatively widely spaced from low-voltage pins 52. The pins provide for conducting operating voltages to electron gun 57, as depicted. It will be noted that all pins, which are shown as extending axially from the neck terminus 58, are relatively short; that is short relative to the normal pin lengths as in cathode ray tubes having conventional base-socket connection means. Such pins are normally about half an inch in length; pins 52, 54 and 56 according to the invention are preferably about one-quarter of an inch in length.

Each of the low-voltage pins 52 has a relatively thinly insulated, relatively small-diameter wire 60 attached thereto; each of the wires 60 will be noted as being radially outwardly extending. Each high-voltage pin 54 and 56 is depicted as having a relatively thickly insulated, relatively large-diameter, high-voltage wire 62 and 64 attached thereto. All wires are indicated as being attached in close adjacency to neck terminus 58 at attachment points indicated schematically by a series of large dots. The attachment means is preferably by a process that provides for a near-zero-resistance electrical connection, as has been noted with regard to the embodiment of the invention shown by FIGS. 1–3.

Cathode ray tube 50 is indicated as having a shallow base 68 in abutting relationship to neck terminus 58. Base 68 comprises an insulative cylinder filled with an insulative adhesive, as indicated schematically by the small dot pattern. With specific reference to FIG. 6, base 68 is depicted as having a closed end 72 and an open end 74 facing neck terminus 58. The open end 74 of base 68 according to the invention has a plurality of relatively small crenelations 76 equal in number to the number of low voltage wires 60. Crenelations 76 provide for receiving and passing, in spacing alike to low-voltage pins 52, low-voltage wires 60. The crenelations 76 preferably have rounded bottom sections, as depicted, for accommodating the tubular envelope configuration of the associated wires 60.

Two relatively large crenelations 78 and 80 are provided for receiving and passing, in spacing alike to the high-voltage pins 54 and 56, high-voltage wires 62 and 64, respectively. The benefits of this embodiment according to the invention are such that the low-voltage wires 60 are maximally electrically isolated one from the others, and from high-voltage wires 62 and 64 by their spacing, their radially outward extension, and the insulative adhesive 70. The overall axial length of tube 50 is reduced by the shallowness of base 68, the relative shortness of the pins, and the radially outward extension of the wires.

The recommendations and limitations as to the number of pins and wires, wire gauges, types of attachments and materials, and adhesive set forth in connection with the embodiment of the invention described and shown by FIGS. 1–3, apply as well to this embodiment of the invention shown by FIGS. 4–6.

Figure 4:
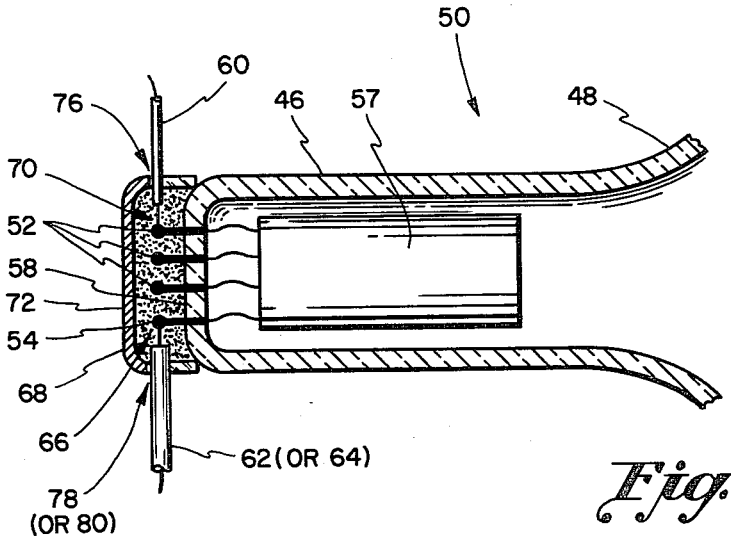
FIG. 4 is a cross-sectional view of the neck and a part of the funnel of a cathode ray tube depicting another embodiment of the means for making electrical connection to a cathode ray tube according to the invention.
Figure 5:
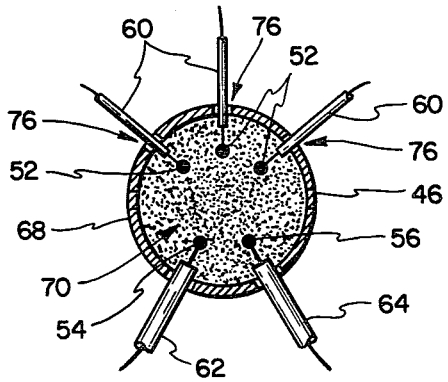
FIGS. 5 and 6 are plan and perspective views respectively of the embodiment of this invention depicted in FIG. 4, and showing additional details of the means and method for making electrical connection to a cathode ray tube according to the invention.
Figure 6:
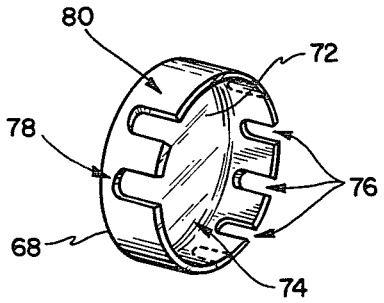

The maximal electrical isolation of high-voltage wires from the low-voltage wires provided by the FIGS. 4–6 embodiment of the invention is particularly valuable in cathode ray picture tubes have a very narrow neck, and where the electron gun is of the type that requires the entry of at least two relatively high voltages through the base. An electron gun of this type is fully described and claimed in U.S. Pat. No. 3,995,194, assigned to the assignee of this invention. The electrodes of the four-element main focus lens of the U.S. Pat. No. 3,995,194 electron gun, designated as an "extended field lens", require two potentials of about seven and twelve kilovolts, which must enter the base in company with several low-voltage potentials having magnitudes of a few volts to a kilovolt. It is deemed not feasible to use the standard bass-socket assembly to introduce potentials of this range into the base of the recently adopted very narrow-neck "mini-neck" cathode ray picture tubes, which typically have an inside diameter of slightly more than three-quarters of an inch. The embodiment of the invention shown by FIGS. 4–6 make possible the entry of relatively high voltages through the neck terminus.

An improved method for use in the manufacture of cathode ray picture tubes comprises the following, with reference to the embodiments of the invention shown by FIGS. 4–6. Pins 52, 54 and 56 are formed to be relatively short; that is short relative to the normal pin length found in cathode ray tubes having standard base-socket connection means. A relatively thinly insulated, relatively small diameter wire 60 is attached to each of the low-voltage pins 52 and extended radially outwardly. Relatively thickly insulated, relatively large-diameter wires 62 and 64 are attached to high-voltage pins 54 and 56, respectively, and extended radially outwardly.

A shallow base 68 is provided, consisting of an electrically insulative cylinder of a diameter substantially equal to the diameter of neck 46. Cylinder 68 is provided with a closed end and an open end. A plurality of small crenelations 76 equal in number of low-voltage wires 62, and alike in spacing to pins 52 are provided in open end 74. The crenelations 76 provide for receiving and passing wires 60. Similarly, at least one relatively large crenelation, shown in the subject embodiment as being two crenelations 78 and 80, are provided in open end 74 for receiving and passing high-voltage wires 62 and 64.

Base 68 is filled with a thermo-setting insulative adhesive 70. Base 68 is then placed into abutting relationship with neck terminus 58 in an orientation matching ones of crenelations 76, 78 and 80 with associated ones of wires 60, 62 and 64, for receiving and passing the wires. Base 68 is then heated to a temperature effective to thermo-set adhesive 72.

It is intended that the subject matter in the above depiction shall be interpreted as illustrative and not in a limiting sense.

I claim:

1. In a cathode ray picture tube having a narrow neck terminated by a plurality of electrically conductive pins extending axially from the neck terminus, said tube being characterized by each pin being relatively short and having a radially outwardly extending, electrically conductive wire attached thereto in close adjacency to said neck terminus, said tube having a shallow base for accepting and enclosing said pins in abutting relationship to said neck terminus, said base comprising an insulative cylinder filled with an electrically insulative adhesive, said base having a closed end and an open end facing said terminus, said open end having a plurality of crenelations equal in number to said wires for receiving and passing said wires, such that said wires are maximally electrically isolated one from the others by their spacings, their radially outward extension, and said insulative adhesive; said base is adhered to said neck terminus by said adhesive; and the overall axial length of said tube when connected for operation is reduced by the shallowness of said base, the relative shortness of said pins, and the radially outward extension of said wires.

2. A base for cathode ray picture tube having a narrow neck terminated by a plurality of electrically conductive pins extending axially from the neck terminus, said base being characterized by each pin having a radially outwardly extending, electrically conductive wire attached thereto in close adjacency to said neck terminus, said tube having a shallow base in abutting relationship to said neck terminus for accepting and enclosing relatively short ones of said pins, said base comprising an insulative cylinder filled with an electrically insulative adhesive, said base having a closed end and an open end facing said neck terminus, said open end having a plurality of crenelations equal in number to said wires for receiving and passing said wires, such that said wires are maximally electrically isolated one from the others by their spacings, radially outward extension, and said insulative adhesive; said base is adhered to said neck terminus by said adhesive; and the overall axial length of said tube when connected for operation is reduced by the shallowness of said base, the relative shortness of said pins, and the radially outward extension of said wires.

3. In a cathode ray picture tube having a narrow neck terminated by a plurality of closely spaced, electrically conductive low-voltage pins and at least one high-voltage pin relatively widely spaced from said low-voltage pins, said pins extending axially from the neck terminus, said tube being characterized by said pins being relatively short, and each low voltage pin having a relatively thinly insulated, relatively small-diameter, radially outwardly extending wire attached thereto, and said high-voltage pin having a relatively thickly insulated, relatively large-diameter, radially outwardly extending high-voltage wire attached thereto, said wires being attached in close adjacency to said neck terminus, said tube having a shallow base in abutting relationship to said neck terminus for accepting and enclosing said relatively short pins, said base comprising an insulative cylinder filled with an electrically insulative adhesive and having a closed end and an open end facing said neck terminus, said open end having a plurality of relatively small crenelations equal in number to said low-voltage wires for receiving and passing, in spacing alike to said low-voltage pins, said low-voltage wires, and a relatively large crenelation for receiving and passing in spacing alike to said high-voltage pin said high-voltage wire, such that said wires are maximally electrically isolated one from the others by their spacings, their radially outward extension, and said insulative adhesive; said base is adhered to said neck terminus by said adhesive; and the overall axial length of said tube when connected for operation is reduced by the shallowness of said base, the relative shortness of said pins, and the radially outward extension of said wires.

4. A base for a cathode ray picture tube having a narrow neck terminated by a plurality of relatively closely spaced, electrically conductive low-voltage pins and at least one high-voltage pin relatively widely spaced from said low-voltage pins, said pins extending axially from the neck terminus, said tube being characterized by each low-voltage pin having a relatively thinly insulated, relatively small-diameter, radially outwardly extending wire attached thereto, and said high voltage pin having a relatively thickly insulated, relatively large-diameter, radially outwardly extending wire attached thereto, said wires being attached in close adjacency to said neck terminus, said tube having a shallow base in abutting relationship to said neck terminus for accepting and enclosing relatively short ones of said pins, said base comprising an insulative cylinder filled with an electrically insulative adhesive and having a closed end and an open end facing said neck terminus, said open end having a plurality of relatively small crenelations equal in number to said low-voltage wires for receiving and passing, in spacing alike to said low-voltage pins, said low-voltage wires, and a relatively large crenelation for receiving and passing in spacing alike to said high-voltage pin said high-voltage wire, such that said wires are maximally electrically isolated one from the others by their spacings, their radially outward extension, and said insulative adhesive; said base is adhered to said neck terminus by said adhesive; and the overall axial length of said tube when connected for operation is reduced by the shallowness of said base, the relative shortness of said pins and the radially outward extension of said wires.

5. For use in the manufacture of a cathode ray picture tube having a narrow neck terminated by a plurality of closely spaced, electrically conductive low-voltage pins and at least one high-voltage pin widely spaced from said low-voltage pins, said pins extending axially from the neck terminus, an improved method for making electrical connection to said pins of said tube comprising:

forming said pins to be relatively short, that is, short relative to the normal pin length found in cathode ray tubes having standard base-socket connection means;

attaching a relatively thinly insulated, relatively small-diameter, radially outwardly extending low-voltage wire to each of said low-voltage pins;

attaching a relatively thickly insulated, relatively large-diameter, radially outwardly extending high-voltage wire to said high-voltage pin;

providing a shallow base consisting of an electrically insulative cylinder of a diameter substantially equal to the diameter of said neck, said cylinder having a closed end and an open end facing said terminus;

providing in said open end a plurality of relatively small crenelations equal in number to said low-voltage wires and alike in spacing to said low-voltage pins for receiving and passing said low-voltage wires;

providing in said open end a relatively large crenelation alike in spacing to said high-voltage pin for receiving and passing said high-voltage wire;

filling said base with a thermo-setting insulative adhesive;

placing said open end of said base into abutting relationship with said neck terminus in an orientation matching ones of said crenelations with associated ones of said wires for receiving and passing said wires;

heating said base to a temperature effective to thermo-set said adhesive;

such that said wires are maximally electrically isolated from each other by their spacings, their radially outward extension, and said insulative adhesive; said base is adhered to said neck terminus by said adhesive; and the overall axial length of said tube when connected for operation is reduced by the shallowness of said base, the relative shortness of said pins and the radially outward extension of said wires.

6. The method according to claim 5 wherein the relatively short pins provided have a length of about one-quarter inch.

* * * * *